United States Patent [19]

Rubner et al.

[11] 4,006,616

[45] Feb. 8, 1977

[54] WEATHER SEALED LOCK MECHANISM

[75] Inventors: Hugo G. Rubner, Milwaukee; Robert R. Spreng, Brookfield, both of Wis.

[73] Assignee: Briggs and Stratton Corporation, Wauwatosa, Wis.

[22] Filed: Sept. 25, 1975

[21] Appl. No.: 616,580

[52] U.S. Cl. ..... 70/455

[51] Int. Cl.[2] ..... E05B 17/18

[58] Field of Search ..... 70/455, 423

[56] References Cited

UNITED STATES PATENTS

| | | | |
|---|---|---|---|
| 2,680,965 | 6/1954 | Jacobi | 70/455 |
| 2,690,071 | 9/1954 | Jacobi | 70/455 |
| 3,122,013 | 2/1964 | Jacobi | 70/455 |
| 3,303,678 | 2/1967 | Bernard et al. | 70/455 |
| 3,367,156 | 2/1968 | Johnstone | 70/455 |
| 3,754,423 | 8/1973 | Seidewand | 70/455 |

*Primary Examiner*—Paul R. Gilliam
*Assistant Examiner*—Kenneth J. Dorner
*Attorney, Agent, or Firm*—Ira Milton Jones & Associates

[57] ABSTRACT

Lock mechanism comprising a key operable cylinder rotatably mounted in a lock body, and characterized by internal and external weather seals for the cylinder. The external seal comprises annular sealing means encircling an enlarged head on the front of the cylinder. The internal seal comprises a keyhole shutter confined in a cavity in the front of the head.

11 Claims, 7 Drawing Figures

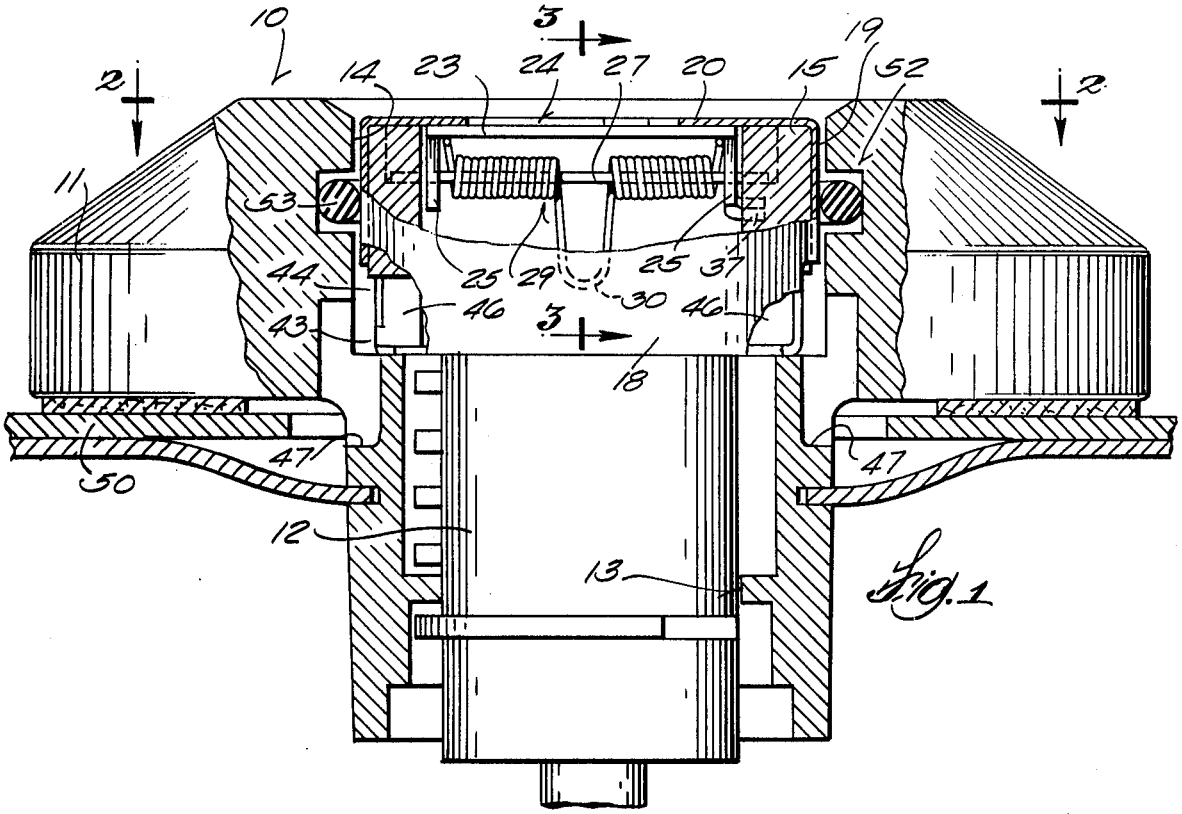
Fig. 1
Fig. 2.
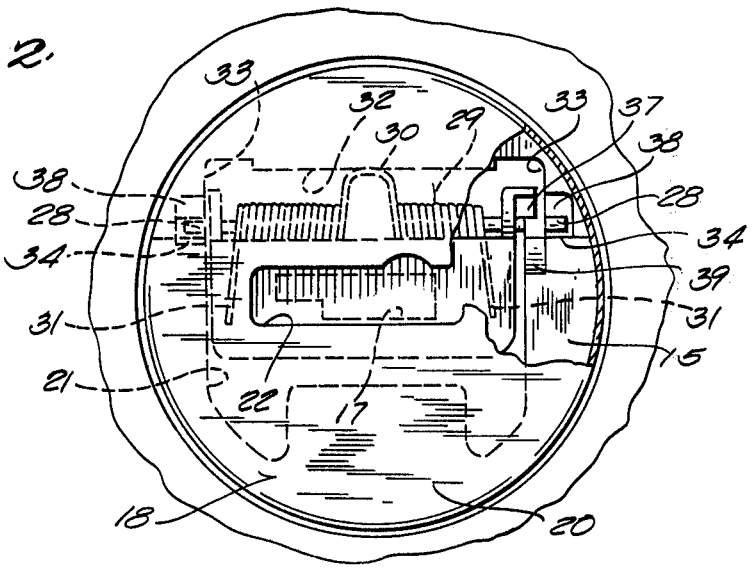

Fig. 3
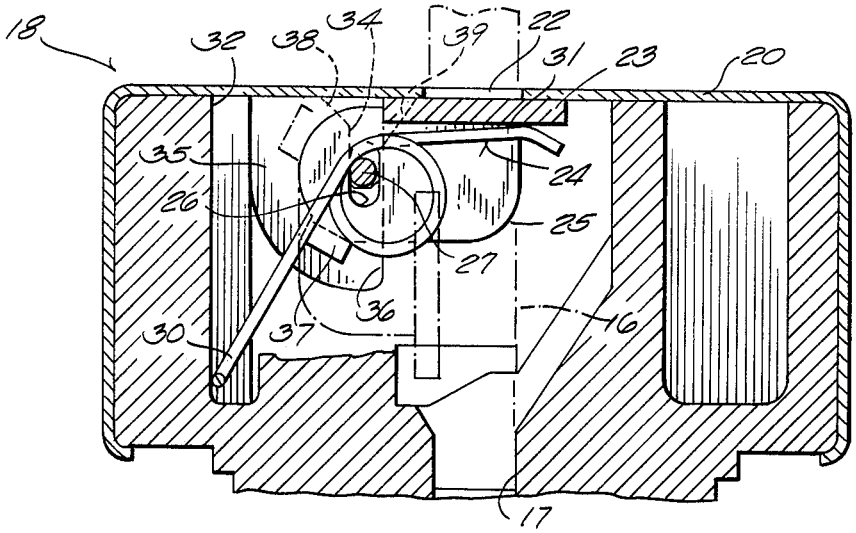
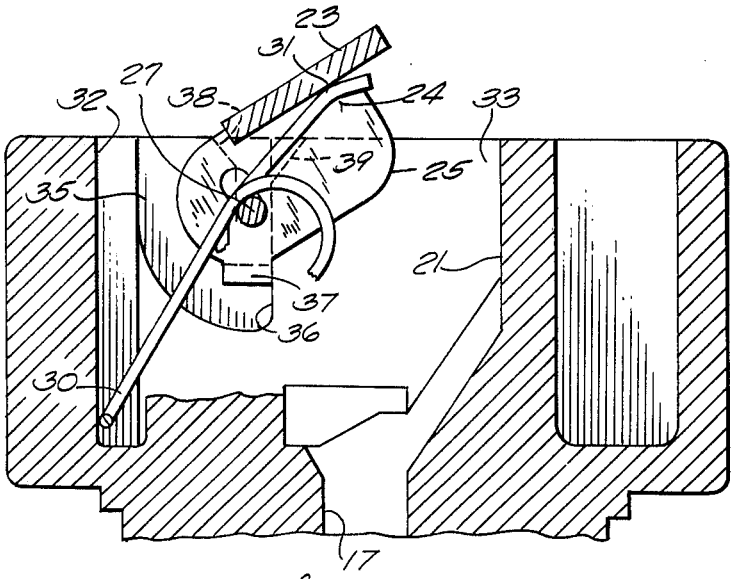
Fig. 4

WEATHER SEALED LOCK MECHANISM

This invention relates to weather sealed cylinder lock mechanisms of a type particularly well suited for use on automotive vehicles. A typical lock mechanism of this nature comprises a cylinder mounted in a bore in the body of the lock and rotatable between locked and unlocked positions upon insertion of a proper key into a key slot in the cylinder.

As is customary, the key is insertable into the key slot through a keyhole in a cap or other wall secured to the cylinder and extending across its front. A shutter confined in a cavity in the cylinder is spring urged to an operative position engaging the underside of the cap to normally close the keyhole and provide a seal that prevents rain or other moisture from entering the keyhole and gaining access to those portions of the cylinder containing the lock tumblers and their springs.

In some such weather sealed locks, the shutters were mounted for sliding motion crosswise of the cylinder axis, to and from operative positions closing the keyhole. In other locks, the shutters were pivotally mounted for fore and aft swinging motion of a flap thereon to and from a keyhole closing position of sealing engagement with the underside of the cap all around the keyhole therein.

This invention is more particularly concerned with weather sealed lock mechanisms having such pivotally mounted keyhole shutters, and a general object thereof is to provide improvements in such mechanisms and especially in the manner of mounting the shutter in the shutter receiving cavity of the lock cylinder.

With these observations and objectives in mind, the manner in which the invention achieves its purpose will be appreciated from the following description and the accompanying drawings, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 1 is an enlarged view, partly in elevation and partly in section, of a cylinder lock mechanism embodying the weather seal of this invention;

FIG. 2 is a face view of the lock mechanism, with parts broken away to better illustrate the shutter;

FIG. 3 is a sectional view taken on the line 3—3 of FIG. 1;

FIG. 4 is a sectional view similar to FIG. 3, but with the cap removed from the front of the lock cylinder;

Figure 5:
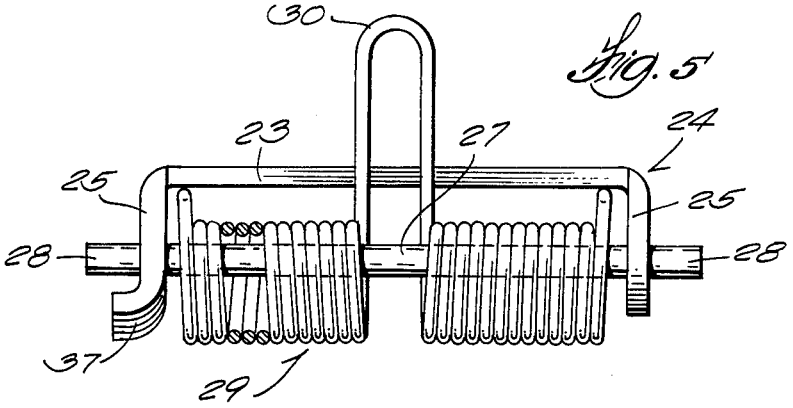
FIG. 5 is an elevational view of the shutter assembly per se.
Figure 6:
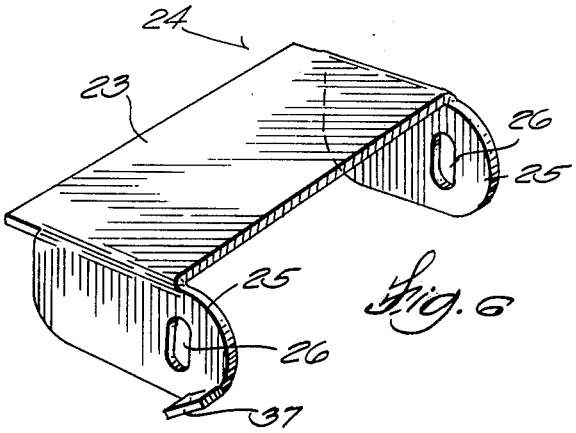
FIG. 6 is a perspective view of the shutter per se.

Referring now to the accompanying drawings, the numeral 10 generally designates a cylinder lock mechanism of this invention. The mechanism comprises a body 11 and a lock cylinder 12 constrained to rotary motion in a bore 13 in the body.

In the lock mechanism shown, the bore 13 opens forwardly to the front of the body through a counterbore 14, which accommodates an enlarged coaxial head 15 on the front of the cylinder.

The cylinder has a number of tumblers which normally engage in tumbler receiving grooves in the lock body to prevent rotary motion of the cylinder out of a locking position. As is customary, the tumblers are retracted to free the cylinder for rotation to an unlocking position upon insertion of a proper key 16 into an axial key slot 17 in the cylinder. A flat wall 20, which is normal to the cylinder axis, extends across its front to provide the closure for a forwardly opening shutter receiving cavity 21 in the cylinder head. If desired, the closure wall 20 can be in the nature of a disc or plate fixed in relation to the cylinder in any conventional manner, but in the present case it has been shown as comprising the bottom of a cup-like sheet metal cap 18 having a cylindrical side wall which snugly encircles the head and which is curled over the underside thereof to secure the cap in place.

A keyhole 22 in the closure wall 20 registers with the keyslot 17 to provide an entrance for the latter. The keyhole is normally closed and sealed against the entry of moisture into the cavity 21 by an elongated flat flap 23 formed as part of the shutter 24 of this invention.

The shutter 24 can comprise a sheet metal stamping formed with spaced apart parallel ears 25 bent over from the ends of the flap 23 to positions perpendicular thereto and at one side thereof. Each ear has an elongated aperture 26 therein oriented to have its long axis perpendicular to the flap. A shutter hinge pin 27 spanning the space between the ears has its opposite end portions 28 extending through the apertures 26 to provide trunnions about which the shutter can rock.

A coiled torsion spring 29 acts upon the shutter flap to hold it firmly engaged with the underside of the closure wall 20 all around the keyhole 22 therein. The convolutions of the spring encircle the hinge pin 27 and are divided into pairs, one at each side of a centrally disposed foot 30 formed integrally with the spring. The remote ends 31 of the spring are extended to engage the underside of the flap 23.

It will thus be apparent that the shutter 24, the hinge pin 27 and the torsion spring 29 comprise a subassembly, shown best in FIG. 5. This subassembly can be assembled in the cylinder cavity 21 as a unit, as will be described more fully hereinafter.

When the shutter is properly installed in the cavity 21, the foot 30 on its spring extends toward the bottom of the cavity and bears against a wall 32 thereof which is spaced from and faces one long side of the keyhole 22, as seen best in FIG. 3. The ends 31 of the spring act on the flap 23 and tend to rotate the shutter in the counterclockwise direction (as seen in FIG. 3) to thus firmly hold it in flat intimate engagement with the underside of the closure wall 20.

One of the main features of the invention resides in the facility with which the shutter and cap 18 can be assembled on the lock cylinder. Both the shutter and the opposite side walls 33 of the cavity 21 adjacent to the ends of the keyhole 22 are formed in a way that assures this objective.

For this purpose, the cavity walls 33 are provided with sockets 34 to receive the trunnions 28 provided by the end portions of the shutter hinge pin. These sockets open laterally to the cavity 21, and forwardly to the underside of the cavity closure wall 20. Their placement is such that with the trunnions on the hinge pin properly sealed in their bottoms, the pin will mount the shutter for rocking motion about an axis normal to that of the cylinder and parallel to the long sides of the keyhole 22, at the side thereof adjacent to the cavity wall 32. The flap 23 on the shutter, of course, extends away from the cavity wall 32 and under the keyhole 22.

It is another important feature of this invention that the construction of the shutter makes it possible for the shutter spring 29 not only to impose a desirably strong keyhole closing torsional force upon the shutter, but also to move either or both ends of the shutter bodily forwardly relative to the hinge pin by whatever amount is necessary to assure flatwise self-sealing engagement of its flap 23 with the underside of the cavity closure wall 20 all around the keyhole 22 therein. It is for this latter reason that the mounting ears 25 on the shutter are provided with the aforesaid elongated apertures 26 in which the shutter hinge pin is received.

With this arrangement, for example, the shutter will be able to adjust itself to assure the desired flatwise sealing engagement of its flap 23 with the underside of the closure wall 20 if for any reason one or both trunnions 28 on the hinge pin are not fully seated in the bottoms of their sockets 34. Accordingly, the assembly of the shutter in the shutter receiving cavity is far less critical than would be the case if the shutter was unable to move bodily relative to its hinge pin as described.

Still another important feature of the invention resides in the provision of cooperating stops on the shutter and the lock cylinder which are relied upon during assembly of the shutter in the cavity for the elimination of an assembly operation which would otherwise be essential. It is for this reason that one of the side walls 33 of the cavity 21 is provided with a recess 35 which, like the sockets 34, opens forwardly to the front of the cylinder and laterally to the interior of the cavity 21. This recess is located directly adjacent to one of the sockets 34, and it has one edge 36 which faces toward the cavity wall 32 and is engageable by a lug 37 formed on one of the shutter ears 25 to provide the aforesaid cooperating stops for the shutter.

During assembly of the shutter subassembly into the cavity 21, the foot 30 on the torsion spring must be inserted into the cavity in engagement with the wall 32 thereof. This, of course, requires the foot to be swung down from the position thereof seen in FIG. 5, where it is shown in engagement with the long edge of the shutter flap nearest the hinge pin.

With the spring foot held in the proper position for insertion into the cavity 21, and the trunnions 28 in register with the mouths of their sockets 34, the shutter assembly is pushed into the position seen in FIG. 4. At that position, the trunnions are seated in the bottoms of their sockets and the lug 37 on the shutter is in engagement with the edge 36 of the recess 35.

It is important to note that the torsion spring will at this time perform an important function. Its convolutions will bear upon the hinge pin and jam the trunnions thereon against those side walls of their respective sockets which face the cavity wall 32, to thus hold the trunnions against forward displacement out of their sockets. In addition, the lug 37 on the shutter will be held in engagement with the edge 36 of recess 35 to prevent the shutter flap from swinging outwardly of the mouth of the cavity beyond an angular position at which the flap defines a substantially small obtuse angle to the cylinder axis. This is to say, that the flap 23 will be maintained in a position only about 30° forwardly of its normal keyhole closing position, as seen in FIG. 4.

The advantage thus gained is that after the shutter subassembly is assembled into the cylinder cavity, the shutter flap does not have to be manually held in an angular position like that seen in FIG. 4 during application of the cap 18 to the cylinder head. A time consuming and complicated assembly step is thereby eliminated.

As soon as the free end of the cylindrical wall on the cap is curled around the underside of the head, the closure wall 20 of the cap will hold the shutter with its flap normal to the cylinder axis, in the keyhole sealing position of the flap seen in FIG. 3. The lug 37 on the shutter then no longer serves any useful purpose, but it will be noted that the recess 35 is wide enough to accommodate the lug in any position to which the shutter may be thereafter rocked about its hinge pin, so that such rocking motion of the shutter can take place freely and without restraint other than that provided by the torsion spring 29.

The assembly of the shutter into the cylinder cavity 21 can also be facilitated to a considerable degree through the provision of inclined surfaces 38 on the walls of the sockets 34 at their mouths, which act to cam the trunnions 28 downwardly and inwardly, toward the cylinder axis during initial insertion of the trunnions into their sockets. A similar inclined surface 39 at the outer portion of the edge 36 on the recess 35 is engageable by the stop lug 37 on the shutter during such initial assembly motion thereof into the cavity 21, to assure proper entry of said lug into the recess.

Proper insertion of the key 16 into the key slot 17 requires the nose 40 on the end of the key to be inserted into that end of the keyhole 22 closest to the recess 35 in the cavity 21 and marked by a notch 41 in the edge of the keyhole. This is essential for retraction of the lock tumblers by the bitting 42 along one edge of the key, which bitting must be passed through the end portion of the keyhole remote from the notch 41.

Figure 7:
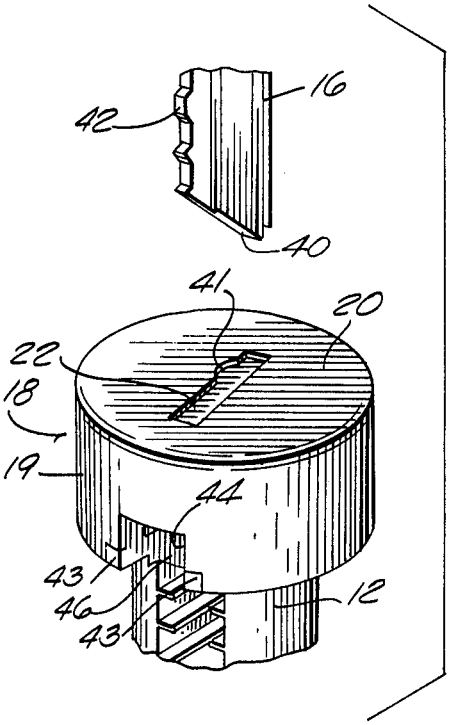
FIG. 7 is a fragmentary perspective view of the front end portion of a lock mechanism embodying the invention and a key therefor shown in position for insertion into the key slot of the lock cylinder.

It will thus be apparent that it is important to have the keyhole 22 properly oriented with respect to the key slot 17. According to this invention, such proper orientation of the keyhole and keyslot can be assured by means which fixes the closure wall 20 in a predetermined position on the cylinder head. Thus, for example, the locating means here shown can comprise a pair of small circumferentially spaced lugs 43 on the enlarged head 15 at one side thereof adjacent to its inner axial extremity, and a notch 44 in the cylindrical side wall of the cap having an enlarged mouth in which said lugs are received (see FIG. 7).

As will be seen, the circumferentially spaced lugs 43 prevent the cap 18 from fully seating on the enlarged head until the locating notch 44 in its cylindrical side wall is aligned with the lugs to have its opposite side edges engaged thereby.

It is a further feature of the invention that the cap locating notch 44 also registers with one of a pair of diametrically opposite drain holes 46 in the lock cylinder, opening through the axially innermost portion of its enlarged head and cap from the cavity 21. In turn, the drain holes are shown in registry with drain openings 47 through portions of the lock body adjacent to the inner axial extremity of the enlarged head on the lock cylinder.

The lock mechanism of this invention is ideally suited for installation on the doors and deck covers of automotive vehicles, and can also be used to advantage with locking gasoline caps such as are now in widespread use.

In either case, the lock body is ordinarily mounted in a way that disposes the axis of its cylinder as near as possible to horizontal. For example, the lock body can be attached in any desired fashion to an upright supporting wall 50, which may be that of a vehicle door or fender, but with one set of drain holes 46–47 lowermost.

Such orientation of the mechanism is important in that it facilitates drainage of any water that may enter the cavity in the cylinder head at times when the vehicle is run through automatic car washing apparatus, or is otherwise cleansed by subjecting it to powerful jets of water. At such times water can force open the shutter 24 and enter the cavity 21 containing it. Any such water entering the cavity, however, will drain therefrom through the registering holes 46–47 that are disposed lowermost in the assembly.

Further assurance against the entry of water into the mechanism can be provided by an external seal 52 for the lock cylinder, to prevent water from seeping into the bottom of the counterbore 14 in the clearance space between its wall and the adjacent side wall 19 of the cap 18. This external seal comprises an O-ring 53 confined in a groove in the lock body opening to its counterbore, and tightly embracing the cylindrical wall 19 of the cap. The O-ring, of course, is located a short axial distance outwardly of the drain holes in the cylinder and lock body.

From the foregoing description, together with the accompanying drawings, it will be apparent to those skilled in the art that this invention provides a lock mechanism having improved weather sealing means which is not only exceptionally effective, but which features a keyhole shutter constructed in a way that substantially facilitates assembly thereof in the mechanism.

Those skilled in the art will appreciate that the invention can be embodied in forms other than as herein disclosed for purposes of illustration.

The invention is defined by the following claims.

We claim:

1. A rotatable lock cylinder having in a forward end thereof a cavity in which a shutter is receivable and to the bottom of which an axial key slot opens, said cylinder also having a covering wall secured thereto normal to the cylinder axis and extending across the mouth of the cavity to close the same, said wall having a keyhole therein aligning with the key slot, said cylinder being characterized by:

A. a shutter in said cavity comprising a flap to sealingly engage the rear surface of said wall all around the keyhole therein;

B. means pivotally mounting the shutter for fore and aft rocking motion of its flap toward and from sealing engagement with the rear surface of said wall, comprising 1. a hinge pin extending across the cavity at one side of the keyhole, and
2. means on the cylinder defining sockets which open unrestrictedly to the rear surface of said wall and laterally inwardly to opposite sides of the cavity, in which sockets the opposite end portions of the hinge pin are received;

C. a spring in the cavity 1. having an arm which reacts against a surface portion on the cylinder that faces laterally into the cavity and extends substantially parallel to the hinge pin at the side thereof remote from the keyhole, and
2. having at least one other arm that acts upon the shutter to firmly but yieldingly urge its flap forwardly into sealing engagement with the rear surface of said wall; and D. cooperating abutment means on the cylinder and the shutter engageable prior to securement of said wall to the cylinder to prevent spring propulsion of the shutter about its pivot axis beyond a position at which its flap extends only a short distance out of the cavity and defines but a small obtuse angle to the cylinder axis, said abutment means comprising 1. another surface on the cylinder, in said cavity, which faces toward the first mentioned surface portion on the cylinder and which is defined by a recess at one side of the cavity that is adjacent to one of said sockets, and
2. a lug on said shutter extending into said recess and engageable with said other surface on the cylinder upon rotation of the shutter to its said position, said lug being spaced to the side of the hinge pin that is remote from the flap and said recess being wide enough to allow movement of said lug away from said other surface on the cylinder when the flap pivots rearwardly toward the bottom of the cavity upon insertion of a key for the cylinder into said keyhole and key slot.

2. The lock cylinder of claim 1, wherein said sockets have forwardly widened mouths which are normally closed by said covering wall and which facilitate assembly of the hinge pin thereinto.

3. The lock cylinder of claim 1, wherein said recess opens to the front of the cylinder, further characterized by an inclined surface on the front of the cylinder at said recess engageable by said lug to guide the same into the recess during assembly of the shutter into said cavity.

4. The lock cylinder of claim 1, further characterized by:

A. the shutter extending lengthwise between opposing side surfaces on the cylinder at said opposite sides of the cavity, and having ears thereon which overlie said side surfaces, and holes in said ears through which opposite end portions of the hinge pin project;

B. and said holes being elongated in directions to allow said aforesaid swinging motion of the shutter flap and to provide for bodily fore and aft motion of both ends of the shutter independently of one another relative to the hinge pin, to thereby assure intimate flatwise engagement of the shutter flap with the rear surface of the cover.

5. The lock cylinder of claim 4, wherein said spring has two sets of coils and wherein the first mentioned arm is disposed between said sets of coils and intermediate said ears, further characterized by:

said spring having two other arms that act upon the shutter, one inwardly adjacent to each of said ears, said other arms being thus effective to urge the shutter flap bodily forwardly to whatever position of the flap will assure its intimate flatwise engagement with the rear surface of the cover.

6. The lock cylinder of claim 4 wherein said lug is on one of said ears.

7. The lock cylinder of claim 1, further characterized by:

A. the cylinder having an enlarged coaxial head on its forward end;

B. said covering wall comprising part of a cap having a cylindrical side wall embracing the head and engaging the underside of the head;

C. the head and the side wall of the cap having registering holes therein leading from said cavity to the exterior of the cylinder at opposite sides thereof;

D. indicating means on said covering wall designating the correct attitude at which a key for the cylinder is to be inserted into the keyhole and key slot;

E. and cooperating locating means on edge portions of one of the holes in said cylindrical wall and on an adjacent portion of the head defining the correct orientation of said cap on the cylinder head.

8. The lock cylinder of claim 7 comprising part of a lock mechanism characterized by:

A. a lock body having a bore opening to its front through a counterbore;

B. the cylinder being rotatably received in said bore and having its head disposed in said counterbore;

C. drain apertures in the body registering with said holes in the side wall of the cap;

D. and annular sealing means in said counterbore, encircling the side wall of the cap at a location forwardly of said holes therein.

9. The cylinder lock mechanism of claim 8, wherein said sealing means comprises:

A. a groove in the lock body opening to the counterbore therein;

B. and an O-ring confined in said groove and snugly encircling the side wall of the cap on the cylinder head.

10. A rotatable lock cylinder having in a forward end thereof a cavity in which a shutter is receivable and to the bottom of which an axial key slot opens, said cylinder also having a covering wall secured thereto normal to the cylinder axis and extending across the mouth of the cavity to close the same, said wall having a keyhole therein aligning with the key slot, said cylinder being characterized by:

A. a shutter in said cavity comprising a flap for sealingly engaging the rear surface of said wall all around the keyhole therein;

B. a hinge pin connected with the shutter for pivotally mounting the same for fore and aft rocking motion of its flap toward and from sealing engagement with the rear surface of said wall;

C. the cylinder further having 1. laterally opposite sockets which open unrestrictedly to the rear surface of said wall and laterally inwardly to opposite sides of the cavity, said sockets being of a size to receive the opposite end portions of the hinge pin and both being spaced in one lateral direction from the key slot, each of said sockets defining a hinge pin engaging surface which faces in said lateral direction, 2. a spring engaging surface in the cavity, between said sockets and spaced in said lateral direction from the hinge pin engaging surfaces, said spring engaging surface facing in the opposite lateral direction, and 3. an abutment surface in said cavity, spaced in said opposite lateral direction from the spring engaging surface and facing the latter;

D. a lug on said shutter, spaced to the side of the hinge pin that is remote from the flap and engageable with said abutment surface prior to securement of said wall to the cylinder to define a forward limit of swinging motion of the shutter at which its flap extends only a short distance out of the cavity and defines only a small obtuse angle to the cylinder axis; and E. a spring in the cavity 1. having one arm reacting against said spring engaging surface, 2. having at least one other arm that acts against the shutter for firmly but yieldingly urging its flap forwardly into sealing engagement with the rear surface of said wall, and 3. having a medial portion which reacts against the hinge pin to impose bias upon said arms and, when the shutter is at its said limit of swinging motion, to confine the hinge pin against said hinge pin engaging surface so that the latter cooperates with said lug and said abutment surface in confining the shutter, hinge pin and spring against forward displacement out of the cavity.

11. The lock cylinder of claim 10 comprising a part of a lock mechanism that comprises a lock body, further characterized by:

A. said cylinder having on its front end portion an enlarged coaxial head that defines, at its rear, a circumferential shoulder;

B. said covering wall comprising part of a cap having a cylindrical side wall embracing said head and engaging about said shoulder;

C. said lock body having a bore therein that opens to a front end thereof through a counterbore, said cylinder being rotatably received in said bore and having its head disposed in said counterbore;

D. said lock body having a groove opening to said counterbore therein and extending around the same; and E. an O-ring confined in said groove and snugly encircling the side wall of the cap on the cylinder head to provide a seal between the cylinder and the lock body.

* * * * *